United States Patent [19]

Corghi

[11] Patent Number: 4,960,034

[45] Date of Patent: Oct. 2, 1990

[54] FLUID-DRIVEN MULTI-CYLINDER OPERATING UNIT TIRE REMOVAL MACHINES

[75] Inventor: Remo Corghi, Correggio, Italy

[73] Assignee: Corghi Elethromeccanics S.p.A., Parma, Italy

[21] Appl. No.: 252,388

[22] Filed: Oct. 3, 1988

[30] Foreign Application Priority Data

May 18, 1988 [IT] Italy ..... 46851 A/88

[51] Int. Cl.[5] ..... F01B 13/06; B60C 25/138

[52] U.S. Cl. ..... 91/491; 157/1.24

[58] Field of Search ..... 91/491, 492, 497; 157/20, 1.24

[56] References Cited

U.S. PATENT DOCUMENTS 3,042,090 7/1962 Foster ..... 157/20

3,274,898 9/1966 Faisandier ..... 91/491

4,478,132 10/1984 Braddock ..... 91/491

4,522,110 6/1985 Sammuelsson ..... 91/491

4,724,742 2/1988 Bigo ..... 91/497

*Primary Examiner*—Leonard E. Smith

[57] ABSTRACT

A fluid-driven multi-cylinder operating unit, particularly for tire removal machines comprising a rotor (3) with a radial series of equidistant coplanar, single-acting cylinder-piston units (5, 6) fed in succession by an annular distributor (15), with their rods interacting, by way of end rollers (9), with a track (10) which is coaxial to the rotor (3) and fixed to the stator (1) and which includes a succession of semicylindrical cavities (11) in a number less than the number of cylinder-piston units (5, 6) and joined together by cusps (12); there being provided a valve for throttling the pressurized fluid feed pipe to said cylinder-piston units.

5 Claims, 3 Drawing Sheets

FLUID-DRIVEN MULTI-CYLINDER OPERATING UNIT TIRE REMOVAL MACHINES

BACKGROUND AND SUMMARY OF THE INVENTION

In machines for removing and remounting tires from and onto both automobile and heavy vehicle wheels, the shaft which carries the rim self-centering and locking device is generally rotated by an electromechanical geared motor unit. This means that the speed of rotation of the shaft carrying the self-centering device is strictly related to the number of poles in the electric motors being used. Two-pole motors are normally used, and therefore have two fixed speeds of rotation.

In this field there is a need to vary the rotational speed according to the operations carried out and the type of rim and tire being used. Geared electric motors are not able to satisfy these requirements unless special very costly and therefore inconvenient means are used.

The object of the present invention is to satisfy said requirements, this object being attained by using a fluid-driven multi-cylinder operating unit in direct engagement with the shaft carrying the self-centering device, said unit being controlled by a valve which throttles the feed pipe to allow the shaft speed to be varied at will.

This method, besides attaining the stated object also has the advantage of not requiring a mechanical reduction gear and, more importantly still, of providing a constant static torque on the self-centering device. Finally, it is possible to use the same source of pressurised fluid to also feed a rectilinear operating (cylinder-piston) unit for operating the self-centering device. The combination and interaction of said devices enables a mechanical system to be obtained which inter alia is very compact and of small overall size.

The constructional and operational characteristics of the present invention will be more apparent from the description of a preferred embodiment given hereinafter by way of a non-limiting example, wherein.

Figure 1:
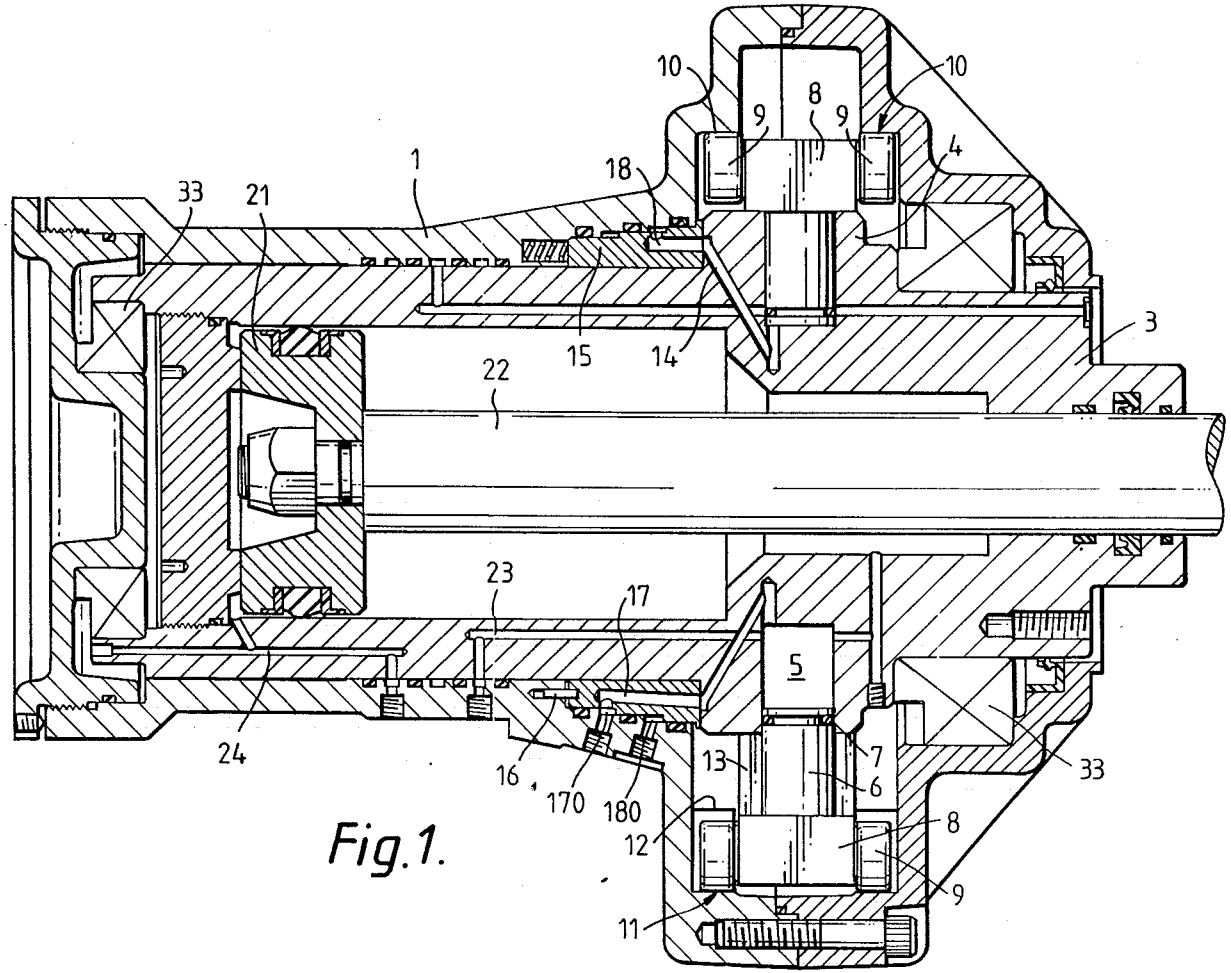
FIG. 1 is an axial section through the motor according to the present invention.
Figure 2:
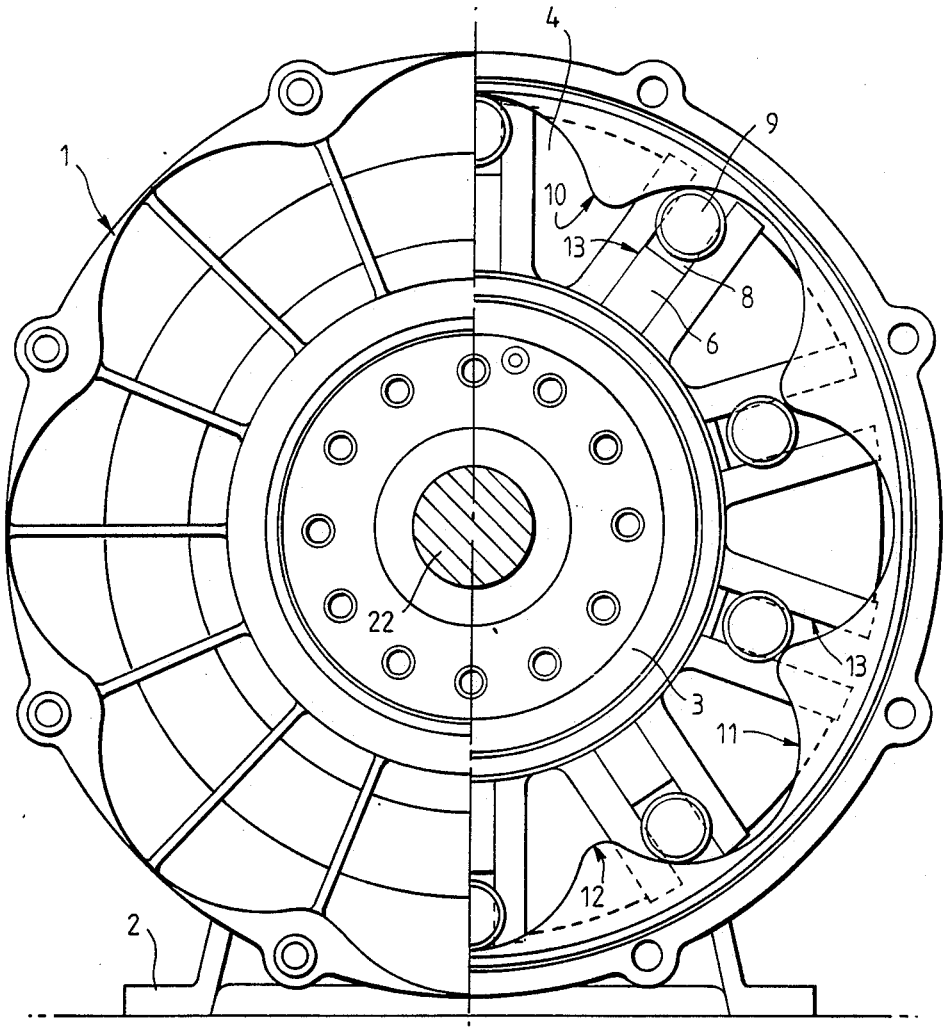
FIG. 2 is a partial sectional front view thereof.
Figure 3:
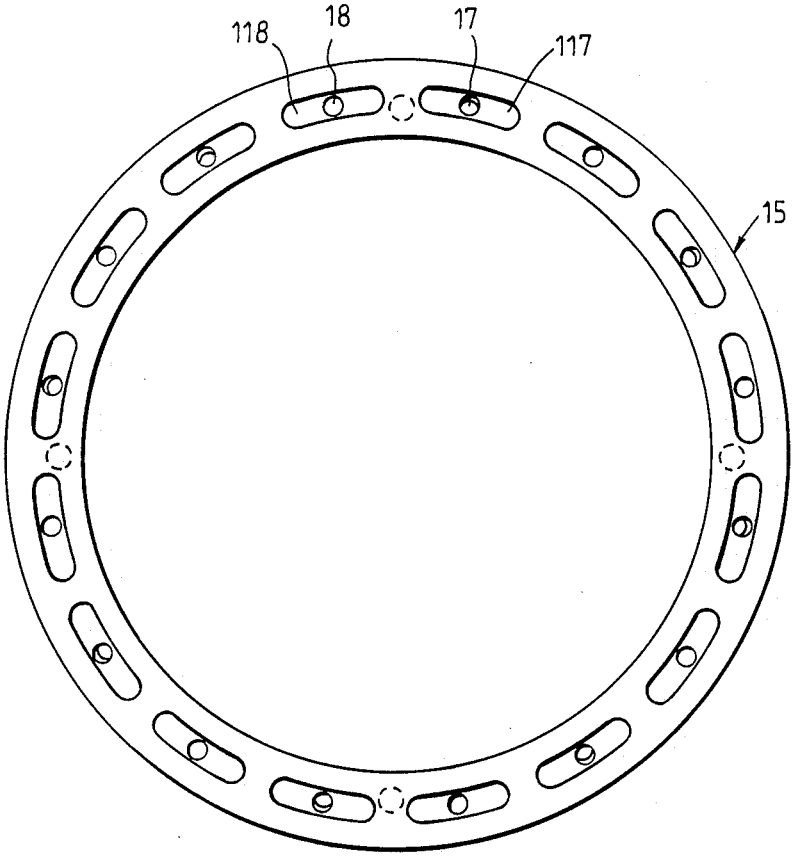
FIG. 3 is a front view of the annular distributor.

The figures of the present invention show that the motor consists of an outer casing or stator 1 fixed by feet 2 to the load-bearing structure of the tire removal machine, not shown for simplicity. In its interior there is a rotary member or rotor 3 supported by suitable bearings 33 and having a circular wall 4 in which a certain number of cylindrical cavities 5, ten in the illustrated example, are provided radially, each carrying a piston 6 with a relative seal gasket 7. At its top, each piston 6 carries an orthogonal cross-member 8, at the ends of which are provided two idle rollers 9. These rollers are each in contact with one of two identical coaxial rolling tracks 10 provided in the stator 1. Each track 10 extends along an ideal circumference and comprises a series of identical equidistant semicylindrical recesses 11 with their concavity facing inwards and joined to a like number of rounded cusps also facing the rotor axis. In the illustrated case the recesses are eight in number.

Each cross-member 8 carrying the rollers 9 slides in suitable opposing guides 13 provided on the circular wall 4 of the rotor 3 in correspondence with each cylindrical cavity 5. On one side of the circular wall 4 there is provided a series of ten channels 14, each communicating with an individual cavity 5 and with a drive fluid distributor 15 which is elastically urged in a fluid-tight manner against said side of the wall 4. The distributor 15, in the form of a ring, is torsionally locked by pins 16 (FIG. 1) to the stator 1. The distributor 15 comprises eight channels 17 alternating with a further eight channels 18, which for a certain direction of rotation are used for drive fluid entry and exit respectively. This is done through two annular chambers 170 and 180 respectively, formed in the casing 1 and connected to suitable feed and discharge pipes leading to the pressurised fluid source. The channels 17 and 18 open at the distributor wall in front of slot-shaped cavities 117 and 118 which ensure continuity of feed and discharge respectively for a certain angle of rotation of the rotor 3.

The rotor 3 slidingly carries in its interior a piston 21, the rod 22 of which emerges in a fluid-tight manner from the front end of the rotor 3. This piston is operated in both directions by fluid fed through suitable ducts 23 and 24 also connected to said pressurised fluid source.

The piston 21 and rod 22 form a rectilinear operating unit for the self-centering device of the tire removal machine. The mutual arrangement of the feed/discharge channels 17 and 18 and the cylindrical cavities 5 are such that the pistons 6 are fed with pressurised fluid when the respective rollers 9 are in contact with that part of the cylindrical recess 11 which extends away from the center, and are connected to discharge when the respective rollers 9 are in contact with that wall of the recess 11 which moves near to the center of rotation.

The present invention is not limited to the signal embodiment described and illustrated, but comprises all technical equivalents of the aforesaid means and their combinations, provided these are formed within the context of the following claims.

What is claimed is:

1. A fluid-driven multi-cylinder operating unit which is particularly used for tire removal machines which comprises a rotor provided with a plurality of radially disposed, equidistant, coplanar single-acting cylinder-piston units which are fluid-actuated in succession by an annular distributor, their rods interacting, by way of end rollers, with a track which is coaxial to the rotor and fixed to a stator and which includes a succession of semi-cylindrical recesses which are less in number than the number of rotor cylinder-piston units and joined together by cusps, wherein at an axial center of the rotor there is provided a passage for a rod of a rectilinear cylinder-piston unit, the rectilinear cylinder-piston unit being fed from the same pressurized fluid source that feeds the radial rotor cylinder-piston units.

2. The fluid-driven unit as claimed in claim 1, wherein the distributor is rigid with the stator and comprises a ring including two series of spaced-apart, alternately-positioned holes for feed and discharge respectively, said holes communicating with a feed chamber and a discharge chamber which are rigid with the stator and with a series of channels, each of which leads to one of said single-acting cylinder-piston units provided in the rotor; each series of holes of the distributor being composed of a number of holes equal to the number of recesses of the track.

3. A fluid-driven multi-cylinder operating motor which is particularly used for tire removal machines, said unit comprising:

a rotor having a plurality of radially disposed, equidistant and coplanar single-acting cylinder-piston units;

a stator for housing said rotor;

an orthoganal cross member fixed to a distal end of each said plurality of radially disposed cylinder-piston units;

idle rollers rotatably mounted at opposing ends of said orthoganal cross member;

a rectilinear cylinder-piston unit disposed in an axial passageway of said stator and axially central to said rotor;

a track formed coaxial to the rotor and fixed to an outer casing of said motor for guiding the idle rollers of the orthoganal cross member in an annular orbit about said cylinder-piston unit, wherein said track includes a succession of semi-cylindrical unit recesses which are less in number than said plurality of rotor cylinder-piston units;

pressurized fluid supply means for independently actuating both said plurality of rotor cylinder-piston units and said rectilinear cylinder-piston unit to enable a complete stroke of said rectilinear cylinder-piston unit under all operating conditions of said motor.

4. The motor according to claim 3, wherein said pressurized fluid supply means includes an annular distributor for feeding pressurized fluid to the rotor cylinder-piston units.

5. The motor according to claim 4, wherein the distributor is rigid with the stator and comprises a ring including two series of spaced-apart, alternatively-positioned holes for feed and discharge, respectively, said holes communicating with a feed chamber and a discharge chamber which are rigid with the stator and with a series of channels, each of which lead to one of said rotor cylinder-piston units, each series of hole of the distributor being composed of a number of holes equal to a number of recesses in said track.

* * * * *

UNITED STATES PATENT AND TRADEMARK OFFICE

CERTIFICATE OF CORRECTION

PATENT NO. : 4,960,034

DATED : October 2, 1990

INVENTOR(S) : Remo CORGHI

It is certified that error appears in the above-identified patent and that said Letters Patent is hereby corrected as shown below:

ON TITLE PAGE: Item [73] change the name of the Assignee as follows:

Delete "Corghi Elethromeccanics S.p.A." and insert therefor --CORGHI S.P.A.--.

Signed and Sealed this

Twenty-fifth Day of February, 1992

*Attest:*

HARRY F. MANBECK, JR.

*Attesting Officer*

*Commissioner of Patents and Trademarks*